US006446600B1

(12) United States Patent
Scherer et al.

(10) Patent No.: US 6,446,600 B1
(45) **Date of Patent: *Sep. 10, 2002**

(54) SENSOR ARRANGEMENT AND ENGINE MANAGEMENT DEVICE FOR A COMBUSTION ENGINE

(75) Inventors: Matthias Scherer, Esslingen (DE); Hans Hubert Hemberger, Notzingen (DE); Winfried Stiltz, Weinstadt (DE); Gunther Alberter, Nuremberg (DE)

(73) Assignee: Daimler-Benz Aktiengesellschaft, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 163 days.

(21) Appl. No.: 09/108,491

(22) Filed: Jul. 1, 1998

(30) Foreign Application Priority Data

Jul. 3, 1997 (DE) ..... 197 28 349

(51) Int. Cl.[7] ..... F02D 43/04
(52) U.S. Cl. ..... 123/399; 123/406.52
(58) Field of Search ..... 73/118.1, 118.2; 123/396, 399, 406.52, 494, 438; 701/102

(56) References Cited

U.S. PATENT DOCUMENTS

| | | | | | |
|---|---|---|---|---|---|
| 4,186,602 | A | * | 2/1980 | Blatter et al. | 73/228 |
| 4,893,502 | A | * | 1/1990 | Kubota et al. | 73/118.1 |
| 4,905,544 | A | * | 3/1990 | Ganoung | 74/858 |
| 4,994,739 | A | | 2/1991 | Honda et al. | 324/207.14 |
| 5,055,781 | A | * | 10/1991 | Sakakibara et al. | 324/207.21 |
| 5,355,855 | A | * | 10/1994 | Saikalis | 123/438 |
| 5,623,906 | A | * | 4/1997 | Storhok | 123/399 |
| 5,681,990 | A | * | 10/1997 | Hampo et al. | 73/118.2 |
| 5,718,202 | A | | 2/1998 | Bentz et al. | 123/399 |
| 5,750,887 | A | * | 5/1998 | Schricker | 73/118.1 |
| 5,756,890 | A | * | 5/1998 | Fedison, Jr. | 73/118.1 |

FOREIGN PATENT DOCUMENTS

| | | |
|---|---|---|
| DE | 34 05 935 C2 | 12/1988 |
| DE | 38 26 408 A1 | 2/1989 |
| DE | 40 34 991 C2 | 10/1992 |
| DE | 41 18 218 C2 | 3/1993 |
| DE | 42 43 778 A1 | 6/1994 |
| DE | 42 43 779 A1 | 6/1994 |

OTHER PUBLICATIONS

Bosch, "Massen Durchfulssemesser (*Air Flow Sensor with Temperature Sensor*)", Robert Bosch GmbH, Stuttgart, 1995, XP002132294, pp. 117–118.
Lemme, et al., "Hall–Sensoren in CMOS–Billing und Genau", Electronik, Aug. 1992, XP000310956, pp. 56–62.
H. Lemme, et al., "Hall–Sensoren in CMOS—billig und genau", Elekronik, 17/1992, pp. 59–62.

* cited by examiner

*Primary Examiner*—Willis R. Wolfe
*Assistant Examiner*—Mahmoud M. Gimie
(74) *Attorney, Agent, or Firm*—Kenyon & Kenyon

(57) ABSTRACT

A sensor arrangement and engine management device for a combustion engine, the engine management device including the sensor arrangement for detecting variables indicative of engine load, a mechanism for determining engine load on the basis of measured values supplied by the sensor, as well as a throttle-valve position control loop. At least two of the sensors of the sensor arrangement, which may include a mass air-flow sensor, an intake-air temperature sensor, an induction-pipe pressure sensor, and a throttle-valve position sensor, are microintegrated in a modular unit. The engine management device is made such that a sensor device with the at least two sensors, the mechanism for determining, engine load and/or the throttle-valve position controller used in the throttle-valve position control loop are microintegrated in a modular unit. The engine management device can be used, for example, for controlling a spark ignition engine in a motor vehicle.

20 Claims, 1 Drawing Sheet

SENSOR ARRANGEMENT AND ENGINE MANAGEMENT DEVICE FOR A COMBUSTION ENGINE

FIELD OF THE INVENTION

The present invention relates to a sensor arrangement and an engine management device for a combustion engine, a particularly to a sensor arrangement which detects variables indicative of engine load.

RELATED TECHNOLOGY

The traditional design of sensor arrangements and engine management devices for combustion engines, e.g., for motor vehicles, is such that all the sensors mounted on the engine and the throttle-valve control element are accommodated in their own housings and individually cabled to an engine control unit which contains the entire intelligence for the engine management. Thus, a typical engine control unit, for example a main processor, includes a unit for calculating engine load connected thereto, a safety processor coupled to the main processor for performing prescribed safety functions for an electrically driven throttle valve, a throttle-valve position controller and a corresponding driver stage for driving the throttle-valve control element. The unit for calculating engine load is fed the output signals from an induction-pipe pressure sensor, from an intake-air temperature sensor, and from a mass air-flow sensor. Moreover, the output signal from the throttle-valve position sensor is supplied both to the unit for calculating engine load, as well as to the throttle-valve position controller of the engine control unit. All of the sensors named are positioned separately from one another at proper locations on an air intake section. The throttle-valve control element is usually designed, for example, as a d.c. servomotor having a potentiometer which functions as a throttle-valve position sensor.

German Patent No. 34 05 935 C2, which describes a special throttle-valve control device for a motor vehicle combustion engine, discloses integrating in one shared assembly: a throttle-valve servomotor driven by a processor, a corresponding throttle-valve position sensor, a throttle-valve assembly, in which the throttle valve is arranged on a throttle-valve shaft, the electronic components of an input stage, which is able to feed a setpoint signal to a position control loop, the position control loop itself, as well as a driver stage, which is able to be supplied with an output signal from the position control loop and via which driving signals can be supplied to the servomotor. The intention here is to integrate components in this manner to reduce the outlay required for cabling.

The demand for increased integration and microtechnical implementation of electrical automotive components, such as sensors and actuators, is discussed in the periodical essay by K. Ehlers, Mikrosystemtechnik—Voraussetzung für Funktionsverdichtung und Aufwärtsintegration im Kraftfahrzeug, tm—Technisches Messen [Microsystem Technology—Conditions for Condensing Functions and Upward Integration in Motor Vehicles, tm—Industrial Metrology] 60 (1993) 9, page 347, which essay is hereby incorporated by reference herein.

In addition to potentiometers, a number of other types have been proposed as throttle-valve position sensors, in particular those based on a contactless measuring principle, such as optical, magnetic, and capacitive sampling. Sensors of this kind are described, for example, in German Patent Application Nos. DE 38 26 408 A1, DE 42 43 778 A1 and DE 42 43 779 A1, as well as in German Patent Nos. DE 40 14 885 C2, DE 40 34 991 C2, and DE 41 18 218 C2 and in U.S. Pat. No. 4,994,739.

SUMMARY OF THE INVENTION

An object of the present invention is to make available a sensor arrangement and an engine management device of compact construction. The sensor arrangement and engine management device require only little cabling expenditure and, accordingly, are fail-safe, and render possible an engine management which is precise and, thus, optimized with respect to fuel consumption and exhaust emissions. When necessary, the sensor arrangement and engine management device permit a multi-sensor processing of measured data with the use of redundant sensor information.

The present invention therefore provides a sensor arrangement for a combustion engine, characterized in that at least two sensors (7*a*, 7*b*, 7*c*, 10) from a sensor set are microintegrated in a modular unit. The sensor set includes a mass air-flow sensor, an intake-air temperature sensor, an induction-pipe pressure sensor, and a throttle-valve position sensor.

The present invention also provides an engine management device for a combustion engine, comprising a sensor device (7*a*, 7*b*, 7*c*) for detecting variables indicative of engine load; engine load evaluator (8) for determining engine load on the basis of measured values supplied by the sensor device; and a throttle-valve position control loop having a throttle-valve position controller (8), which generates/produces a throttle-valve adjustment signal using the determined engine load, a throttle-valve servo unit 6 and a throttle-valve position sensor (10). The engine management device is characterized in that the sensor device is made up of a sensor arrangement as stated above, in which the at least two sensors (7*a*, 7*b*, 7*c*, 10), the engine load evaluator (8) for determining engine load and/or the throttle-valve position controller (8) are microintegrated in the modular unit (2).

In the sensor arrangement, at least two of the four sensors, namely intake-air temperature sensor, induction-pipe pressure sensor, mass air-flow sensor, and throttle-valve position sensor, are microintegrated in a shared modular unit. Preferably, all four sensors are integrated in the modular unit in this manner, using microtechnology. This microintegration of a plurality of sensors, which, in particular, are those which sense variables indicative of engine load, economizes on cabling expenditure, permits a compact construction of the sensor arrangement, and offers the condition of a multi-sensor processing of measured data, it being possible, when necessary, to utilize redundant sensor information, for example to enhance accuracy and reliability in acquiring engine load estimates.

Provision is made in the engine management device for such a sensor arrangement. In this context, the engine management device contains a modular unit, in which not only the two to four named sensors of this sensor arrangement are microintegrated, but also the evaluator for determining engine load, preferably in the form of an engine load estimation circuit, and or the throttle-valve position controller, as well. The need is eliminated in this engine management device for cabling expenditure for the components integrated in the modular unit, with microtechnology preferably being used to integrate all four named sensors of the sensor arrangement, the evaluator for determining engine load, and the throttle-valve position controller into the modular unit, which then can be described as a microintegrated, intelligent throttle-valve position- and load-detecting module. Integrating the evaluator for determining engine load and/or the throttle-valve position controller in the modular unit, and thus configuring it outside of the customary engine control unit, means that the corresponding sensor data no longer need to be communicated to the engine control unit. Moreover, the entire engine management device can be assembled relatively compactly in the modular unit, due to the microintegration of the named components.

Also provided is an engine management device with a further development, the throttle-valve position sensor participates in the microintegration, for which it is constructed in a relatively simple, special manner, however in such a way that it still provides the required measuring accuracy.

An engine management device with another further development has a brushless synchronous motor as a throttle-valve control element, the Hall-effect sensor elements usually provided for such a motor for detecting its operating position, being used simultaneously as a throttle-valve position sensor that is included in the microintegration. This allows comparatively exact throttle-valve positional measurements over the entire adjustment range.

In the case of a further developed engine management device, also integrated in the modular unit using microtechnology are power electronics, which are used for energizing the power-consuming components of the modular unit and, in some instances, of a throttle-valve servomotor.

Another further development is an engine management device in which additionally microintegrated in the modular unit is a safety processor unit, which is set up for performing the necessary safety functions for the electrical throttle-valve control. Configuring this processor unit that is usually contained in the engine control unit outside of this unit and placing it in the modular unit promotes the simplification of the engine control unit and, above all, helps one to economize on cabling expenditure and signal-transmission processes, particularly when the evaluator for determining engine load and the throttle-valve position controller are integrated in the modular unit.

BRIEF DESCRIPTION OF THE DRAWINGS

An advantageous exemplary embodiment of the present invention is described in the following and illustrated in the figures in which.

DETAILED DESCRIPTION

Figure 1:
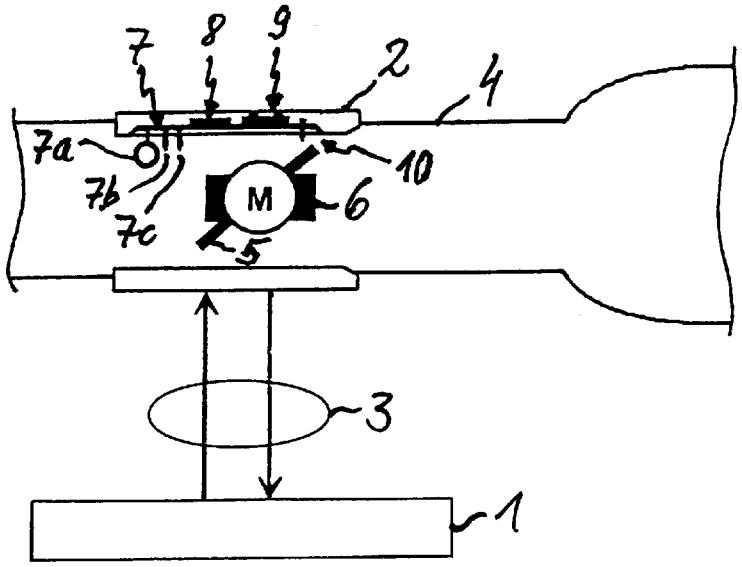
FIG. 1 shows a schematic representation of an engine management device having a corresponding sensor arrangement for a combustion engine.

The engine management device schematically shown in FIG. 1 contains an engine control unit 1 and a throttle-valve position-detecting and load-detecting module 2 designed as an intelligent module, which is implemented using microtechnology and communicates via a serial, digital data line 3 with engine control unit 1 for purposes of exchanging data. Throttle-valve position-detecting and load-detecting module 2 is designed as a toroidally-shaped component part, which is configured on the periphery of an intake manifold 4 of a motor-vehicle combustion engine controlled by the engine management device in the area of a throttle-valve 5 that is swivel-mounted in intake manifold 4. A servomotor 6, preferably a brushless synchronous motor, is used to adjust throttle valve 5.

Contained in throttle-valve position-detecting and load-detecting module 2 in a microintegrated type of construction are all hardware and software components for sensing engine load and for adjusting throttle valve 5, i.e., all sensors required for detecting variables indicative of engine load, an evaluator for determining, i.e., estimating, the engine load on the basis of the measured values of these sensors, and a throttle-valve position control loop. Module 2 includes specially for this purpose a sensor block 7, a signal processing block 8, power electronics 9, and a contactless measuring throttle-valve position sensor 10 configured separately from sensor block 7.

Sensor block 7 includes a mass air-flow sensor 7*a*, an intake-air temperature sensor 7*b*, and an induction-pipe pressure sensor 7*c*, which project in suitable fashion from module 2 into intake manifold 4. Signal processing block 8 includes an evaluator for determining engine load by estimating load, for which are used, in particular, the three output signals, indicative of engine load, from sensors 7*a*, 7*b*, 7*c* of sensor block 7. Also contained in signal processing block 8 are a throttle-valve position controller and a safety processor unit. In this context, throttle-valve position controller, together with throttle-valve servomotor 6 driven by it, and throttle-valve position sensor 10, constitute the throttle-valve position control loop. Via data line 3, module 2 receives the information required for the throttle-valve setting with respect to mass air-flow setpoint value or the setpoint speed of the combustion engine from engine control unit 1 and relays this information pertaining to the actual value of the mass air flow measured by mass air-flow sensor 7*a* via this bidirectional data line 3 to engine control unit 1. The safety processor unit within signal processing block 8 is used to execute the required, e.g., legally prescribed safety functions for the electrical throttle-valve drive circuit. To fulfill the named functions, signal processing block 8 contains the necessary hardware and software having the requisite intelligence, for which it has, in particular, a suitable microprocessor. Power electronics 9, which is likewise microintegrated in module 2, supplies the current-consuming components of module 2 as well as throttle-valve servomotor 6 with the required electrical energy.

It should be easy for a person skilled in microsystem technology to implement module 2 on the basis of the above-described functions to be fulfilled by module 2, so that no further elucidation is required here. By the fact that module 2 includes both the evaluator for determining engine load, as well as the throttle-valve position controller, along with the corresponding driver stage for driving throttle-valve servomotor 6 and, moreover, the safety processor and required power electronics 9, it is no longer necessary to accommodate these components in engine control unit 1 as is customary.

Overall therefore, one gains a number of advantages by using the intelligently designed throttle-valve position-detecting and load-detecting module 2, in which all the hardware and software components for sensing engine load and for adjusting the throttle-valve are integrated using microsystem technology. Thus, microintegrating sensors 7*a*, 7*b*, 7*c* relevant to sensing load in sensor block 7 renders possible the application of multi-sensor measuring data processing, i.e., sensor fusion, to augment the accuracy and reliability of the estimated engine-load values derived from the sensor measured values. In addition, the need is eliminated for a separate temperature compensation for each individual sensor. Integrating signal-processing block 8, along with the safety-processor unit, as well as power electronics 9 in module 2 results in a substantial reduction in cabling expenditure, accompanied by an increased system security, since there is no longer a need to route sensor output signals to engine control unit 1. When module 2 is used, the combustion engine is able to be controlled relatively accurately and reliably in the desired manner, for example to obtain the lowest possible fuel-consumption and exhaust emissions values.

Figure 2:
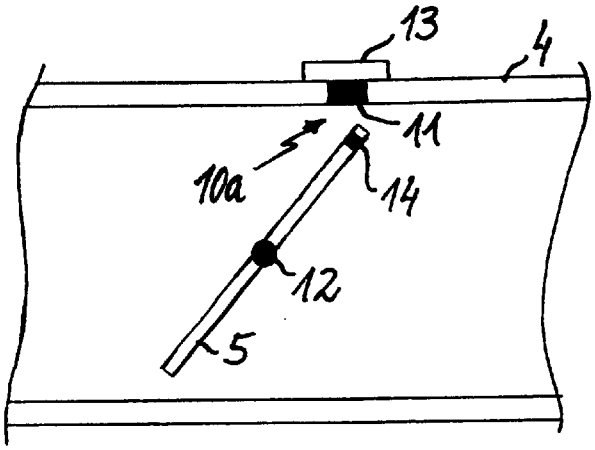
FIG. 2 shows a schematic representation of a first exemplary embodiment of a throttle-valve position sensor that can be employed in the device of FIG. 1.
Figure 3:
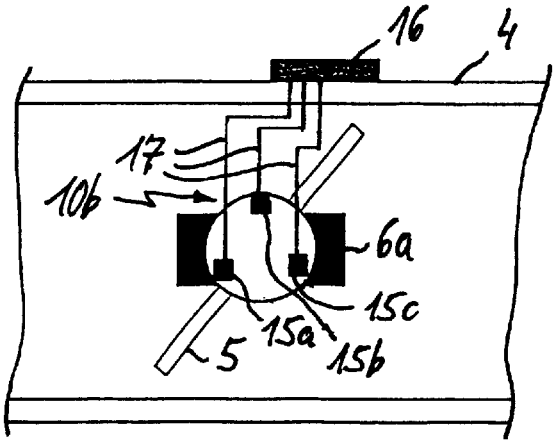
FIG. 3 shows a schematic representation of a second example of a throttle-valve position sensor that can be employed in the device of FIG. 1.

As a further advantage, instead of the standard, fault-prone throttle-valve potentiometer in the engine management device, as a throttle-valve position sensor 10 a contactless measuring sensor is preferably used, whose one sensor component, together with a corresponding evaluation electronics, is microintegrated in module 2. FIGS. 2 and 3 show two such throttle-valve sensors, which are able to be implemented with relatively little outlay.

As a first sensor component, throttle-valve position sensor 10*a* depicted in FIG. 2 contains a Hall element 11, which is arranged on the periphery of intake manifold 4, in the area of throttle valve 5 which is swivel-mounted in intake manifold 4 about a swivel axis 12. Coupled to Hall element 11 is a corresponding, analog evaluation electronics element 13, which is microintegrated in module 2 of FIG. 1, in the same way as Hall element 11. Evaluation electronics element 13 can be constituted, in particular, as a component of signal processing block 8. As a second sensor component, throttle-valve position sensor 10*a* includes a magnetic pellet 14, which is press-fit in on the peripheral side of throttle valve 5 at a location adjacent to the position of Hall element 11 on intake manifold 4, the distance between Hall element 11 and magnetic pellet 14 being small when working with small throttle-valve angles near the closed position, and increasing in response to larger throttle-valve angles. Thus, with little outlay for implementation, this throttle-valve position sensor 10*a* fulfills the requirement of being able to measure, in particular, the smaller throttle-valve angles within the range of between about 0° and 20°, with a high level of accuracy, while making it possible to accept comparatively greater measuring inaccuracies when working with larger throttle-valve angles, which correspond to the combustion engine's upper part-throttle range and full-throttle range.

As one possible variant of throttle-valve position sensor 10*a* of FIG. 2, which essentially has the same properties as mentioned above, a sensor can be used, which in place of Hall element 11, has a carrier frequency generator and, in place of the press-fit magnetic pellet 14, has a corresponding absorbing element implemented as a resonant circuit for the electromagnetic waves emitted by the carrier frequency generator. The analog evaluation electronics element 13 is suitably adapted to this modification, in that it is able to detect the absorption coefficient that is a function of the distance between the carrier frequency generator and the absorber element, and thus is able to detect the adjusted throttle-valve angle.

FIG. 3 shows one simple realization of a throttle-valve position sensor 10*b* for the case that a brushless synchronous motor 6*a* is used as a throttle valve servomotor, whose shaft is coupled in a rotatably fixed manner via a speed-transforming gear unit (not shown) to the shaft of throttle valve 5. The brushless synchronous motor 6*a* used has a plurality of Hall elements 15*a*, 15*b*, 15*c*, which are usually used to detect the exact position of servomotor 6*a*. In the example of FIG. 3, these Hall elements 15*a*, 15*b*, 15*c* on the engine side are used at the same time as the one sensor component of a contactless measuring throttle-valve position sensor 10*b*, whose other sensor component contains a corresponding, suitably designed evaluation electronics element 16, for example in the form of an ASIC module, which is microintegrated in module 2 of FIG. 1 and, for this, is mounted at an appropriate location on the periphery of air intake manifold 4. Again, this evaluation electronics element 16 can also be, in particular, a component of signal processing block 8. The output signals from Hall elements 15*a*, 15*b*, 15*c* are fed via corresponding signal lines 17 routed on the periphery of induction manifold 4 to evaluation electronics 16.

Another way to eliminate the need for a fault-prone, throttle-valve potentiometer is to implement an indirect estimation of the throttle-valve position in signal processing block 8 of module 2 in FIG. 1, on the basis of sensor signals indicative of engine load and, in this manner, to use the totality of the sensors which measure variables indicative of engine load, together with the evaluator for estimating engine load, as a throttle-valve position sensor.

What is claimed is:

1. An engine management device for a combustion engine comprising:

a sensor device for detecting variables indicative of engine load, the sensor device including a sensor arrangement having at least two sensors of a sensor set, the sensor set consisting of a mass air-flow sensor, an intake-air temperature sensor, an induction-pipe pressure sensor, and a throttle-valve position sensor;

an engine load evaluator for determining the engine load on the basis of measured values supplied by the sensor device; and a throttle-valve position control loop including a throttle-valve position controller, a throttle-valve servo unit and a throttle-valve position sensor, the throttle-valve position controller producing a throttle-valve adjustment signal as a function of the determined engine load;

the at least two sensors, the engine load evaluator and/or the throttle-valve position controller being microintegrated in a modular unit.

2. An engine management device for a combustion engine comprising:

a sensor device for detecting variables indicative of engine load, the sensor device including a sensor arrangement having at least two sensors of a sensor set, the sensor set consisting of a mass air-flow sensor, an intake-air temperature sensor, an induction-pipe pressure sensor, and a throttle-valve position sensor an engine load evaluator for determining the engine load on the bases of measured values supplied by the sensor device; and a throttle-valve position control loop including a throttle-valve position controller, a throttle-valve servo unit and a throttle-valve position sensor, the throttle-valve position controller producing a throttle-valve adjustment signal as a function of the determined engine load;

the at least two sensors, the engine load evaluator and/or the throttle-valve position controller being microintegrated in a modular unit;

wherein the throttle-valve position sensor includes a first sensor component in the form of a Hall element or a transmitter of electromagnetic waves linked to an evaluation electronics element and a second sensor component in the form of a magnetic member or an absorber element for electromagnetic waves, the second sensor component being positioned at a peripheral location on a throttle valve so as to permit swivel motion of the throttle valve in an air intake manifold, and the first sensor component being position at an opposed location on the air intake manifold, and the first sensor component as well as the evaluation electronics element being microintegrated in the modular unit.

3. The engine management device as recited in claim 2 wherein the throttle-valve servo unit includes a brushless synchronous motor having position-sensing Hall elements, output signals from the Hall elements being able to be fed to an evaluation electronics element, the evaluation electronics element forming part of the throttle-valve position sensor and being microintergated into the modular unit.

4. An engine management device for a combustion engine comprising:

a sensor device for detecting variables indicative of engine load, the sensor device including a sensor arrangement having at least two sensors of a sensor set, the sensor set consisting of a mass air-flow sensor, an intake-air temperature sensor, an induction-pipe pressure sensor, and a throttle-valve position sensor;

an engine load evaluator for determining the engine load on the basis of measured values supplied by the sensor device; and a throttle-valve position control loop including a throttle-valve position controller, a throttle-valve servo unit and a throttle-valve position sensor, the throttle-valve position controller producing a throttle-valve adjustment signal as a function of the determined engine load;

the at least two sensors, the engine load evaluator and/or the throttle-valve position controller being microintegrated in a modular unit;

wherein the throttle-valve servo unit includes a brushless synchronous motor having position-sensing Hall elements, output signals from the Hall elements being able to be fed to an evaluation electronics element, the evaluation electronics element forming part of the throttle-valve position sensor and being microintegrated into the modular unit.

5. The engine management device as recited in claim 4 further comprising a power electronics element microintegrated in the modular unit, the power electronics element energizing power-consuming components of the modular unit and the throttle-valve servo unit.

6. An engine management device for a combustion engine comprising:

a sensor device for detecting variables indicative of engine load, the sensor device including a sensor arrangement having at least two sensors of a sensor set, the sensor set consisting of a mass air-flow sensor, an intake-air temperature sensor, an induction-pipe pressure sensor, and a throttle-valve position sensor;

an engine load evaluator for determining the engine load on the basis of measured values supplied by the sensor device;

a throttle-valve position control loop including a throttle-valve position controller, a throttle-valve servo unit and a throttle-valve position sensor, the throttle-valve position controller producing a throttle-valve adjustment signal as a function of the determined engine load, the at least two sensors, the engine load evaluator and/or the throttle-valve position controller being microintegrated in a modular unit; and a power electronics element microintegrated in the modular unit, the power electronics element energizing power-consuming components of the modular unit and the throttle-valve servo unit.

7. The engine management device as recited in claim 2 further comprising a power electronics element microintegrated in the modular unit, the power electronics element energizing power-consuming components of the modular unit and the throttle-valve servo unit.

8. The engine management device as recited in claim 3 further comprising a power electronics element microintegrated in the modular unit, the power electronics element energizing power-consuming components of the modular unit and the throttle-valve servo unit.

9. The engine management device as recited in claim 8 further comprising a safety processor unit microintegrated in the modular unit, the safety processor unit for performing safety functions for throttle-valve adjustment.

10. The engine management device as recited in claim 1 further comprising a safety processor unit microintegrated in the modular unit, the safety processor unit for performing safety functions for throttle-valve adjustment.

11. The engine management device as recited in claim 2 further comprising a safety processor unit microintegrated in the modular unit, the safety processor unit for performing safety functions for throttle-valve adjustment.

12. The engine management device as recited in claim 3 further comprising a safety processor unit microintegrated in the modular unit, the safety processor unit for performing safety functions for throttle-valve adjustment.

13. The engine management device as recited in claim 4 further comprising a safety processor unit microintegrated in the modular unit, the safety processor unit for performing safety functions for throttle-valve adjustment.

14. The engine management device as recited in claim 5 further comprising a safety processor unit microintegrated in the modular unit, the safety processor unit for performing safety functions for throttle-valve adjustment.

15. The engine management device as recited in claim 6 further comprising a safety processor unit microintegrated in the modular unit, the safety processor unit for performing safety functions for throttle-valve adjustment.

16. The engine management device as recited in claim 7 further comprising a safety processor unit microintegrated in the modular unit, the safety processor unit for performing safety functions for throttle-valve adjustment.

17. The engine management device as recited in claim 1 wherein at least three sensors of the sensor set are microintegerated in the modular unit.

18. A sensor arrangement for a combustion engine comprising:

at least two sensors of a sensor set, the sensor set consisting of a mass air-flow sensor, an intake-air temperature sensor, an induction-pipe pressure sensor, and a throttle-valve position sensor, the at least two sensors being microintegrated in a modular unit.

19. The sensor arrangement as recited in claim 1 wherein at least three sensors of the sensor set are microintegrated in the modular unit.

20. The sensor arrangement as recited in claim 1 wherein at least four sensors of the sensor set are microintegrated in the modular unit.

* * * * *